US005920043A

United States Patent [19]

Wang et al.

[11] Patent Number: 5,920,043

[45] Date of Patent: Jul. 6, 1999

[54] CIRCUIT BREAKER CONTROL DEVICE FOR A VACUUM CLEANERS DUST HOPPER

[75] Inventors: Chieh-Chun Wang; Chia-Ming Lin, both of Taichung, Taiwan

[73] Assignee: Kinergy Industrial Co., Ltd., Taichung, Taiwan

[21] Appl. No.: 08/914,224

[22] Filed: Aug. 19, 1997

[51] Int. Cl.[6] ..... H01H 9/02; H01H 35/00; A47L 9/28

[52] U.S. Cl. ..... 200/52 R; 15/319; 15/339; 200/332.1

[58] Field of Search ..... 200/61.2, 61.21, 200/83 R–83 Z, 329–332, 52 R; 15/332, 325, 389, 319

[56] References Cited

U.S. PATENT DOCUMENTS

| | | | |
|---|---|---|---|
| 2,230,113 | 1/1941 | Hein | 200/83 R |
| 3,018,343 | 1/1962 | Grostick | 200/61.21 |
| 3,577,869 | 5/1971 | Hosokawa et al. | 15/319 X |
| 4,233,597 | 11/1980 | Kurz | 200/83 R X |
| 4,648,150 | 3/1987 | Morishita et al. | 15/389 |
| 5,187,336 | 2/1993 | Lang et al. | 200/85 R X |
| 5,351,035 | 9/1994 | Chrisco | 340/607 |
| 5,477,586 | 12/1995 | Jacobs et al. | 15/332 |
| 5,659,919 | 8/1997 | Kajihara | 15/325 |

*Primary Examiner*—J. R. Scott
*Attorney, Agent, or Firm*—Bacon & Thomas, PLLC

[57] ABSTRACT

A vacuum cleaner includes a circuit breaking control device responsive to the correct positioning of a dust collecting bag in order to ensure that the vacuum cleaner is not operated without the dust collecting bag. A visible light may be provided to signal that, although the vacuum cleaner main power switch is on, the motors in the vacuum cleaner are not energized because the dust collecting bag is not in place.

6 Claims, 4 Drawing Sheets

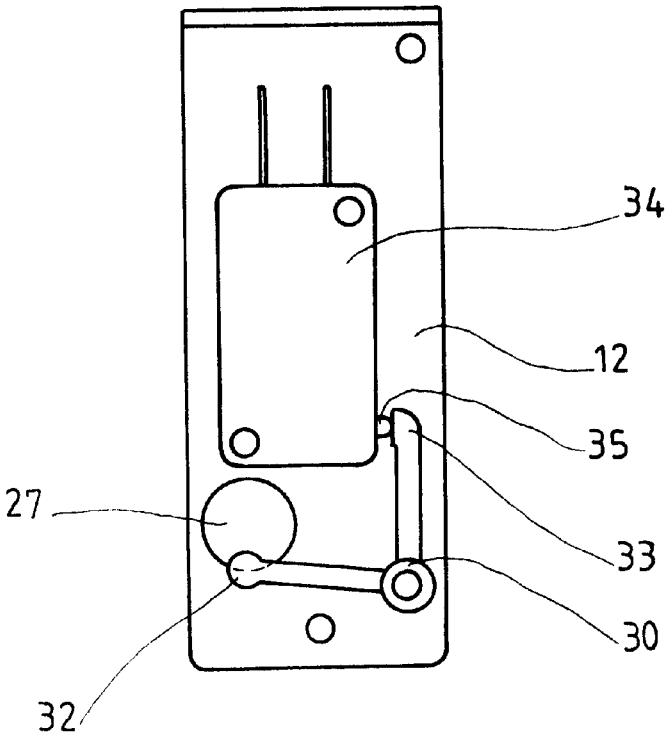
FIG.3-A
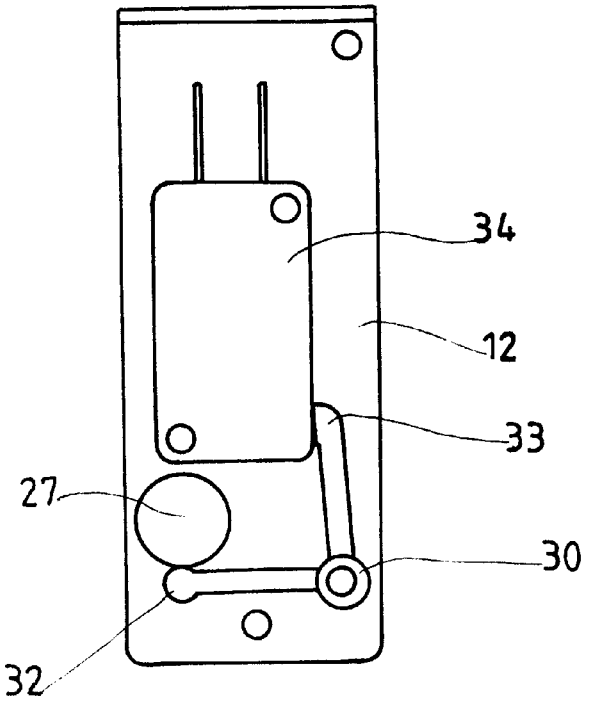
FIG.3-B

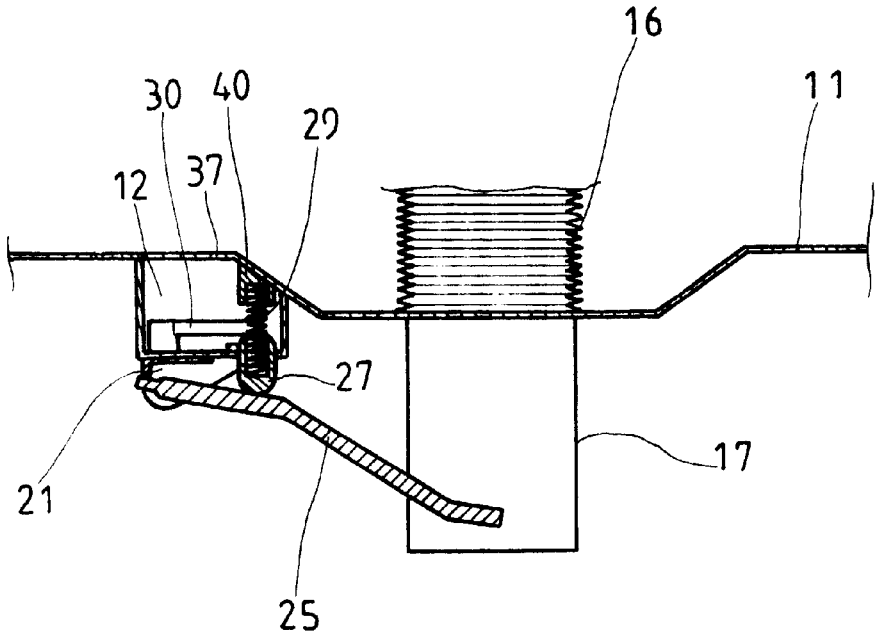
FIG.4-A
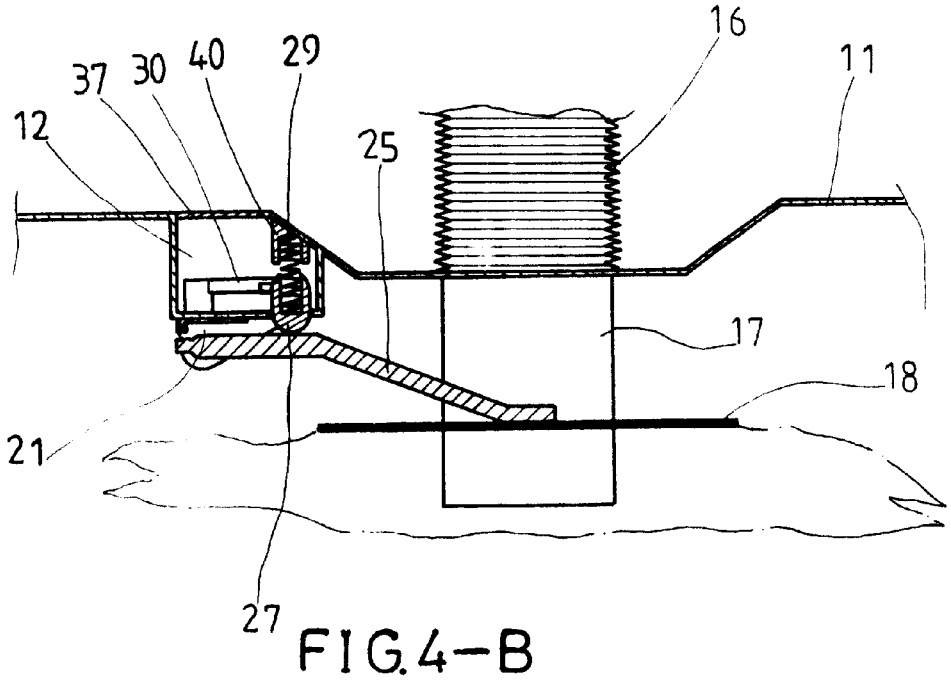
FIG.4-B

CIRCUIT BREAKER CONTROL DEVICE FOR A VACUUM CLEANERS DUST HOPPER

BACKGROUND OF THE INVENTION

1. Field of the Invention

The invention relates to vacuum cleaner devices of the type commonly used for household floor cleaning. More particularly, the invention pertains to a circuit breaking device for disconnecting electric current to all vacuum cleaner motors when the dust collecting bag is not in place.

2. Related Technology

A commonplace dry-vacuum cleaner typically includes an upper portion that includes a handle that can be grasped by the user and an electric motor-driven rotating brush located inside the leading edge of a lower base. The lower base and upper portion are connected by either an internal or external vacuum pipe through which a vacuum is drawn by an electric motor-driven fan. A dust collecting bag is arranged to be inserted into the vacuum pipe between an inlet at the lower base and the motor, so that in-rushing air is filtered so that dust and foreign objects are retained in the bag and thereby prevented from entering the electric motor and other internal regions of the vacuum cleaner.

The dust collecting bag used in commonly found vacuum cleaners is mounted by the user onto a dust collecting port located inside the upper body. The user fits a cover plate over the dust collecting bag by fitting the cover plate into receiving portions of the upper body. In some vacuum cleaners, the user is warned of an absent dust bag by a protruding pin that disables the closure of the cover plate, however such a mechanical warning device does not prevent the energization of the electric motors of the vacuum cleaner. A failure of this type of safety pin can allow the vacuum cleaner to be used, which would likely cause internal damage to the cleaner.

BRIEF SUMMARY OF THE INVENTION

In accordance with the invention, a circuit breaking control device responsive to the correct positioning of a dust collecting bag in a commonplace vacuum cleaner is disclosed. In a second embodiment, a visible light is provided to signal that, although the vacuum cleaner main power switch is on, the motors in the vacuum cleaner are not energized because the dust collecting bag is not in place.

A better understanding of the invention will be obtained with reference to the following detailed description and the appended drawings.

BRIEF DESCRIPTION OF THE DRAWINGS

With regard to the appended drawings:

FIG. 3A illustrates the circuit breaking device when the electric motor circuit is disconnected;

FIG. 3B illustrates the circuit breaking device when the electric motor circuit is connected;

FIG. 4A is a sectional view showing how the circuit breaker remains open when a dust collecting bag is absent;

FIG. 4B is a sectional view showing how the circuit breaker closes when in contact with a dust collecting bag.

DETAILED DESCRIPTION OF A PREFERRED EMBODIMENT OF THE INVENTION

Figure 1:
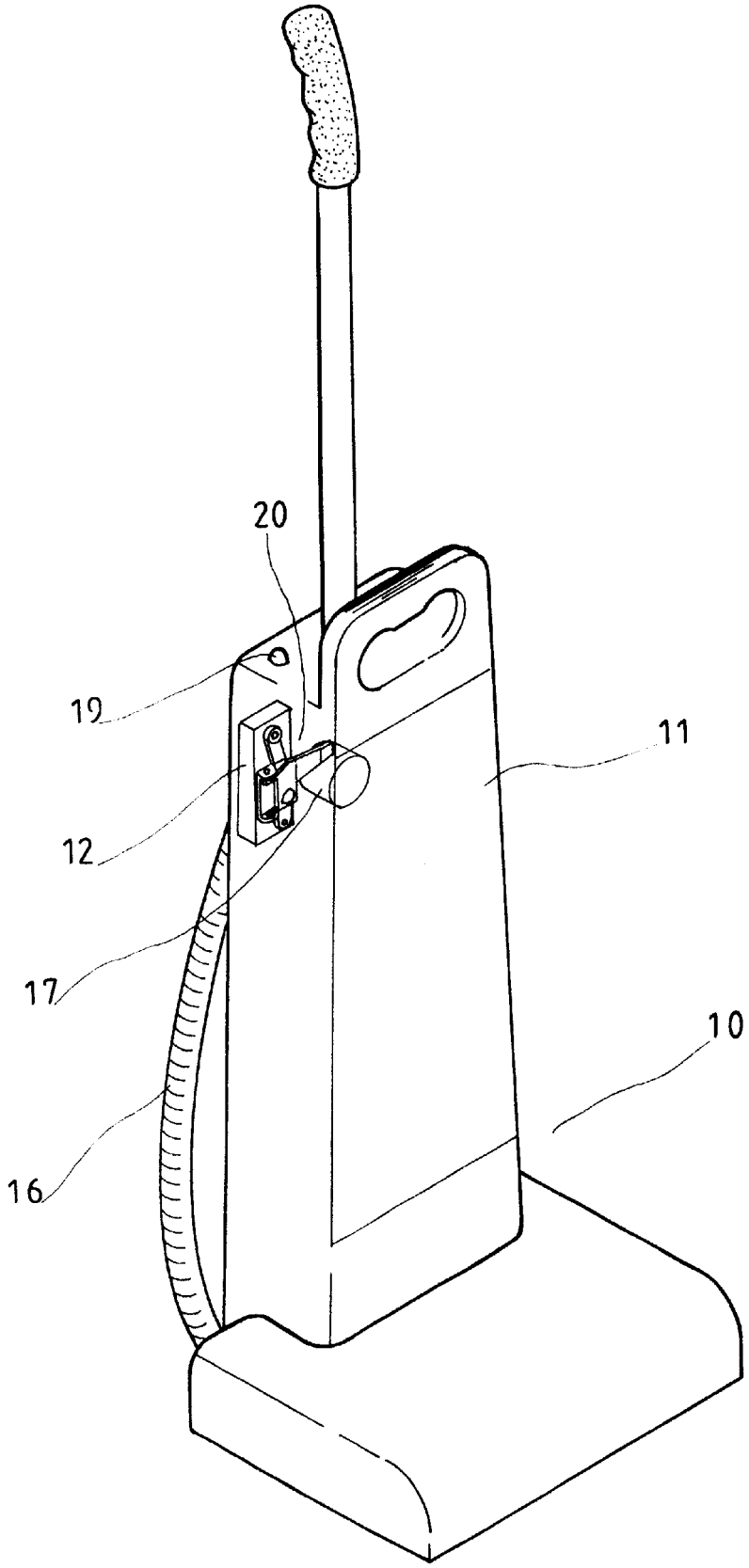
FIG. 1 shows the circuit breaking device positioned on a commonplace vacuum cleaner in accordance with the present invention.

With reference to FIG. 1, vacuum cleaner 10 includes an upper body 11 with a vacuum conveying duct 16 that connects the base of the vacuum cleaner with a dust collecting port 17 located in the upper body 11. Upper body 11 also includes a concave receiving recess 12 located on an inside surface of the upper body 11 for mounting the circuit breaking control device components 20.

Figure 2:
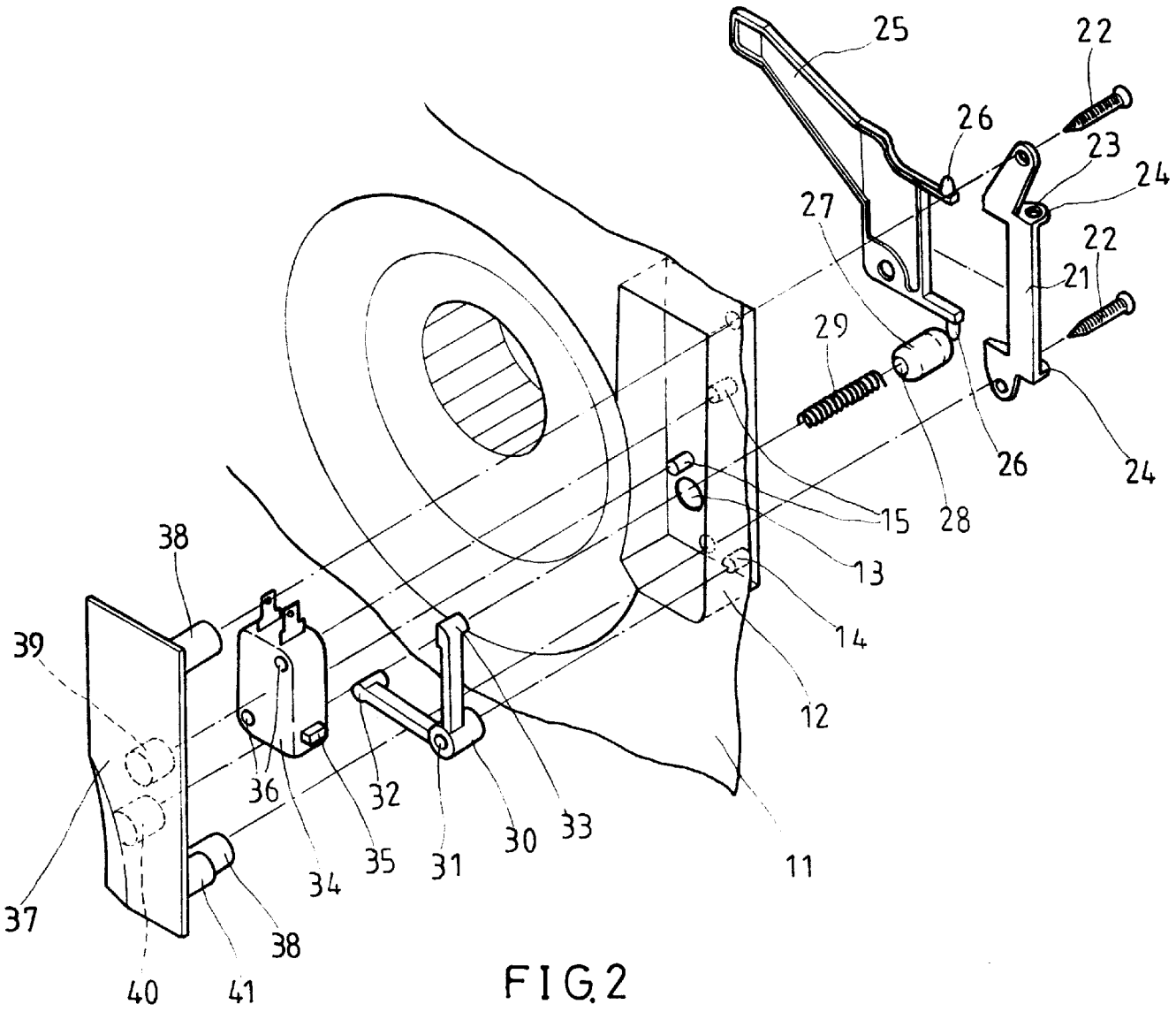
FIG. 2 illustrates the circuit breaking device in accordance with the present invention.

FIGS. 1 and 2 show a circuit breaking control device 20 mounted within the recess 12 that includes a position piece 21 mounted with two screws 22 at the back wall of the recess 12.

As shown in FIG. 2, a concave bracket portion 24 which is integral with the position piece 21, includes mounting holes 23.

Insertion hinges 26, respectively located at the top and bottom of a dust bag detection bracket 25, are arranged to pivotally mount in the mounting holes 23 of the bracket portion 24 of the position piece 21, so that the dust bag detection bracket 25 swivels with respect to the position piece 21.

FIG. 2 also shows a cylindrical sliding knob 27 having an internal hole 28 for receiving a spring 29 inserted into a through hole 13 of the receiving recess 12.

A V-shaped rocking lever 30 having a center hole 31 is pivotally connected to a protruding post 14 that protrudes from the back wall of the recess 12, so that the rocking lever 30 can swivel. A lower fork portion 32 portion of the rocking lever 30 is positioned directly below the cylindrical sliding knob 27, while the upper fork 33 portion of the lever 30 touches the switch button 35 at the microswitch 34.

Microswitch 34 has two positioning holes 36 for mounting microswitch 34 to two protruding posts 15 that protrude from the back wall of the receiving recess 12.

A cover plate 37 having threaded posts 38 located at opposite ends of the plate 37 is arranged to cover the recess 12 and be attached to the back wall of the recess 12 by screws 22. The cover plate 37 has three mounting posts 39, 40 and 41 for mounting the microswitch 34, the spring 29 and the V-shaped rocking lever 30.

FIG. 4A shows the position of the dust bag detection bracket 25 when no dust collecting bag 18 is present. The dust bag detection bracket 25 is positioned near the outer edge of the dust collecting port 17 inside the upper body 11. The spring 29 biases the cylindrical sliding knob 27 against the surface of the dust bag detection bracket 25, which in turn forces the dust bag detection bracket 25 away from the dust collecting port 17. As more clearly visible in FIG. 3A, the cylindrical sliding knob 27 does not touch the V-shaped rocking lever 30, and therefore the switch button 35 on the microswitch 34 remains in an open, disconnected position.

FIG. 4B shows the dust collecting bag 18 positioned at the dust collection port 17 so that a hard portion of the dust collecting bag 18 presses the push piece 25 toward the backside of the machine body 10. As FIG. 3B shows, movement of the push piece 25 pushes the cylindrical knob 27 back into the receiving recess 12 so that it touches the lower fork 32 of the V-shaped rocking lever 30, thereby swiveling the rocking lever 30 downward and pressing the switch button 35 of the microswitch 34 to form an electrical connection.

The breaking circuit control device 20 operates as a dust collecting bag 18 detection means, so that absence of a dust collecting bag 18 causes the electric circuit to be disconnected. A visible indication of this detection is achieved by an indicator light 19 mounted on the exterior surface of the vacuum cleaner 10, at a location visible to the operator. The indicator light 19 lights up when the vacuum cleaner 10 electric circuit is in a disconnected condition, thus informing the operator to install a dust collecting bag 18.

I claim:

1. A circuit breaking control device for a vacuum cleaner comprising:

a bracket member which moves in response to positioning of a dust collection bag in the vacuum cleaner, and thereby detects whether the dust collecting bag is properly positioned; and a switch movable in response to movement of the bracket member, said switch being arranged to prevent supply of electricity to an electric circuit connected to at least one motor in the vacuum cleaner when the bracket member fails to detect proper positioning of the dust collecting bag, thereby preventing the motor from being started unless the bag is properly positioned.

2. The circuit breaking control device of claim 1, wherein said bracket is pivotally biased against a dust collection port and arranged to abut the dust collecting bag following insertion of the dust collecting bag between the bracket and said port.

3. The circuit breaking control device of claim 1, wherein said control device further comprises:

a V-shaped lever having first and second arms separated by a fixed angle, the arms arranged to swivel so that when said dust bag detection bracket moves to said de-energized position, said dust bag detection bracket does not abut the first arm, thereby leaving the electric switch in an electrically open position, and when said dust bag detection bracket moves to said energized position, said dust bag detection bracket abuts and displaces the first arm, thereby causing the second arm to abut and displace a circuit-connecting portion of said electric switch, which causes the electric switch to move to an electrically closed position, whereby said vacuum cleaner motors are electrically de-energized in said switch open position and electrically energized in said switch closed position.

4. The circuit breaking control device of claim 3, wherein said control device further comprises:

a sliding knob, said knob having a first end abutting said dust bag detection bracket and a second end abutting said first arm of said V-shaped lever, whereby pressure exerted by the dust bag detection bracket on said first end causes the sliding knob to slide against the first arm of the V-shaped lever, thereby causing the first arm to swivel.

5. The circuit breaking control device of claim 1, wherein:

said vacuum cleaner has a body portion having a receiving recess formed on an inside surface thereof arranged to receive said control device.

6. The circuit breaking control device of claim 1, wherein said control device further comprises:

an indicator light arranged to illuminate when a switch for starting said motor is switched to an on position and said control device fails to detect the absence of a dust collecting bag.

* * * * *